US007758669B2

(12) United States Patent
Miller et al.

(10) Patent No.: US 7,758,669 B2
(45) Date of Patent: Jul. 20, 2010

(54) PROCESS FOR RECOVERY OF NICKEL AND COBALT BY HEAP LEACHING OF LOW GRADE NICKEL OR COBALT CONTAINING MATERIAL

(75) Inventors: Geoffrey William Miller, Karrinyup (AU); Houyuan Liu, Shortland (AU)

(73) Assignee: BHP Billiton SSM Technology Pty Ltd, Brisbane, Queensland (AU)

( * ) Notice: Subject to any disclaimer, the term of this patent is extended or adjusted under 35 U.S.C. 154(b) by 321 days.

(21) Appl. No.: 10/564,358

(22) PCT Filed: Jul. 13, 2004

(86) PCT No.: PCT/AU2004/000943

§ 371 (c)(1),
(2), (4) Date: May 18, 2006

(87) PCT Pub. No.: WO2005/005671

PCT Pub. Date: Jan. 20, 2005

(65) Prior Publication Data

US 2007/0034056 A1 Feb. 15, 2007

(30) Foreign Application Priority Data

Jul. 14, 2003 (AU) ..... 2003903632

(51) Int. Cl.
*C22B 23/00* (2006.01)
*C22B 3/04* (2006.01)

(52) U.S. Cl. ..... 75/743; 423/138; 423/150.1

(58) Field of Classification Search ..... 75/711, 75/712, 738, 743; 266/101; 423/138, 150.1
See application file for complete search history.

(56) References Cited

U.S. PATENT DOCUMENTS 4,044,096 A * 8/1977 Queneau et al. ..... 423/150.4

(Continued)

FOREIGN PATENT DOCUMENTS

AU 89338/2001 5/2002

(Continued)

OTHER PUBLICATIONS

S. Agatzini-Leonardou and I.G. Zafiratosm, Beneficiation of a Greek serpentinic nickeliferous ore Part II. Sulphuric acid heap and agitation leaching. Hydrometallurgy 74 (2004) p. 267-275.*

(Continued)

*Primary Examiner*—Roy King
*Assistant Examiner*—Mark L Shevin
(74) *Attorney, Agent, or Firm*—Stites & Harbison PLLC; B. Aaron Schulman; Stephen J. Weyer

(57) ABSTRACT

A process for the recovery of nickel and cobalt from laterite ores, the process including the steps of: a) beneficiating the ore to separate it into a beneficiated upgraded ore fraction and a coarse, siliceous low grade rejects fraction which is substantially free from fines and clay materials; b) separately processing the upgraded ore fraction for the recovery of nickel and cobalt; and c) subjecting the low grade rejects fraction to a heap leach process with an acid supplemented solution to create a heap leachate for further nickel and cobalt recovery processing.

19 Claims, 4 Drawing Sheets

U.S. PATENT DOCUMENTS

| | | | | | |
|---|---|---|---|---|---|
| 4,097,575 | A | | 6/1978 | Chou et al. | |
| 4,173,519 | A | * | 11/1979 | Parker et al. | 205/569 |
| 4,548,794 | A | | 10/1985 | Lowenhaupt et al. | |
| 5,571,308 | A | | 11/1996 | Duyvesteyn et al. | |
| 5,642,863 | A | * | 7/1997 | Patzelt et al. | 241/24.13 |
| 6,312,500 | B1 | | 11/2001 | Duyvesteyn et al. | |
| 6,379,636 | B2 | | 4/2002 | Arroyo et al. | |
| 2002/0041840 | A1 | * | 4/2002 | Arroyo et al. | 423/145 |

FOREIGN PATENT DOCUMENTS

| | | | |
|---|---|---|---|
| GR | 1003569 | * | 5/1978 |
| GR | 1001555 | * | 3/1994 |
| GR | 1003569 | | 4/2001 |
| WO | WO-01/32943 | | 5/2001 |
| WO | WO 01/44519 A1 | * | 6/2001 |
| WO | WO-03/093517 | | 11/2003 |
| WO | WO-2004/031422 | | 4/2004 |

OTHER PUBLICATIONS

K. Irons, Heaps of Nickel, Materials World, Feb. 2006, p. 28-30.*

M.G. King, Nickel laterite technology—Finally a new dawn? Journal of Metals, Jul. 2005, p. 35-39.*

B. Wedderburn, Heap leaching of nickel laterities, Malachite Process Consulting, Aug. 2005, p. 1-32.*

S. Agatzini-Leonardou and D. Dimaki. Heap leaching of poor nickel laterites by sulphuric acid at ambient temperature. Paper presented at the International Symposium "Hydrometallurgy '94", Cambridge, England, Jul. 11-15, 1994, and included in the Proceedings, p. 193-208 (IMM and SCI: London).*

B. A. Ferguson et al. Falconbridge Dominicana ore handling and preparation—Part Two: Ore preparation. Proceedings of AIME International Laterite Symposium, New Orleans, Louisiana, Feb. 19-21, 1979, p. 169-181, AIME, New York.*

T.T. Toomver. Development of Inco's selective reduction smelting process for nickel laterite ores. Proceedings of AIME International Laterite Symposium, New Orleans, Louisiana, Feb. 19-21, 1979, p. 252-271, AIME, New York.*

D.R. Weir and V.B. Sefton. Development of Sherritt's commercial nickel refining process for low and high iron laterites. Proceedings of AIME International Laterite Symposium, New Orleans, Louisiana, Feb. 19-21, 1979, p. 325-345, AIME, New York.*

R.A. Alcock. The character and occurrence of primary resources available to the nickel industry. Proceedings of a Symposium on the Extractive Metallurgy of Nickel and Cobalt. 117th Annual Meeting of AIME, Phoenix, Arizona, Jan. 25-28, 1988, p. 67-89, AIME, New York.*

D. Burnvill and D. White. Engineering aspects of the Cawse nickel/cobalt laterite project. Technical Proceedings of ALTA 1999 Nickel/Cobalt Pressure Leaching and Hydrometallurgy Forum, Perth, Australia, May 11-12, 1999. ALTA Metallurgical Services, Melbourne, Australia.*

A. Taylor. Pressure Acid Leaching. Technical proceedings of ALTA 1996 Nickel/Cobalt Laterite Project Development Seminal, Perth, Australia, May 15, 1996, ALTA Metallurgical Services, Melbourne, Australia.*

N. Jansen. The RAMU nickel project. Technical proceedings of ALTA 1995 Nickel/Cobalt Laterites Seminar, Melbourne, Australia, May 4-5, 1995, ALTA Metallurgical Services, Melbourne, Australia.*

A. Taylor. Process Selection. Technical proceedings of ALTA 1996 Nickel/Cobalt Laterite Project Development Seminar, Perth, Australia, May 15, 1996, ALTA Metallurgical Services, Melbourne, Australia.*

T. W. Lambe and R.V. Whitman. Chapter 129: Soil permeability and filter requirements. In: Soil Mechanics, SI Version. John Wiley & Sons, New York, p. 281-294.*

Agatini-Leonardou et al, "Extraction of nickel and cobalt from greek low-grade nickel oxide ores by heap leaching", Aug. 17, 2007, pp. 489-503, vol. 1. No. 17, Proceedings of the Nickel-Cobalt International Symposium.

Taylor, Alan, "Laterites—has the time finally come?", Mar. 1995, pp. 167-170, vol. 172, No. 3, Mining Magazine, Mining Journal Ltd., London, GB.

* cited by examiner

PROCESS FOR RECOVERY OF NICKEL AND COBALT BY HEAP LEACHING OF LOW GRADE NICKEL OR COBALT CONTAINING MATERIAL

FIELD OF THE INVENTION

In general, the present invention relates to a method for improving the recovery of nickel and cobalt from laterite ores. In particular, the present invention provides an improved hydrometallurgical method of extraction of nickel and cobalt from nickel and cobalt containing laterite ores by pressure leaching or atmospheric agitation leaching of the upgraded limonite and saprolite fractions of the ores, and by heap leaching of low grade limonite and saprolite material that is normally rejected during the beneficiation of the ores.

BACKGROUND OF THE INVENTION

Laterite nickel and cobalt ore deposits generally contain oxidic type ores, limonites, and silicate type ores, saprolites, in the same deposits. The higher nickel content saprolites tend to be treated by a pyrometallurgical process involving roasting and electrical smelting techniques to produce ferro nickel. The power requirements and high iron to nickel ore ratio for the lower nickel content limonite and limonite/saprolite blends make this processing route too expensive, and these ores are normally commercially treated by a combination of pyrometallurgical and hydrometallurgical processes, such as the High Pressure Acid Leach (HPAL) process or the Caron reduction roast—ammonium carbonate leach process.

As alternatives to HPAL, which treats limonite or low magnesium laterites only and uses expensive high pressure equipment, atmospheric pressure agitation acid leach processes, and processes combining HPAL for the limonite fraction of an ore followed by atmospheric acid leaching of the saprolite fraction have been disclosed. In order to reduce the size of leaching reactors, high grade limonite and saprolite are preferred for these processes. This leads to rejecting the low grade ore as waste.

The exploitation of many of the lower nickel content ores by the above processes generally requires whole ore processing as there is no effective method to beneficiate the ore. This has the disadvantage that the mineralogical fractions of the ore which may contain lower metal values effectively dilute the total treated ore quality and increase recovery costs.

Even where the laterite ore is amenable to some form of beneficiation, where the upgraded ore is processed by one of the previously discussed methods, the reject fraction containing low nickel and cobalt grades is normally discarded as uneconomic to process by the above methods, thus losing the value of the nickel and cobalt contained in the rejects.

Heap leaching is a conventional method of economically extracting metals from low grade ores and has been successfully used to recover materials such as copper, gold, uranium and silver. Generally it involves piling raw ore directly from ore deposits into heaps that vary in height. The leaching solution is introduced onto the top of the heap to percolate down through the heap. The effluent liquor is drained from the base of the heap and passes to a processing plant where the metal values are recovered.

One problem hindering the heap leaching of nickel and cobalt containing laterite ores is the substantial clay component of such ores. The type of clay content is dependent on the parent rock and the physico chemical environment of the clay formation, but most clays have a detrimental effect on the percolation of the leach solution through the ore.

It has been reported that when laterite is piled dry, the leach solution percolation was poor to impossible. Because of the poor permeability, a low irrigation rate is necessary to allow the solution to leach the nickel and cobalt, thus requiring a leach time that is uneconomical.

U.S. Pat. No. 5,571,308 (BHP Minerals International, Inc) describes a process for heap leaching of high magnesium containing laterite ore such as saprolite. The patent points out that the clay type saprolite exhibits poor permeability, and as a solution to this, pelletisation of the ore is necessary to ensure distribution of the leach solution through the heap.

U.S. Pat. No. 6,312,500 (BHP Minerals International, Inc) also describes a process for heap leaching of laterites to recover nickel, which is particularly effective for ores that have a significant clay component (greater than 10% by weight). The process includes sizing of the ore where necessary, forming pellets by contacting the ore with a lixivant, and agglomerating. The pellets are formed into a heap and leached with sulphuric acid to extract the metal values.

Both the above patents identify the need to pelletise the whole ore feed to obtain the permeability of the heap necessary for successful heap leaching.

The above discussion of documents, articles and the like is included in the specification solely for the purpose of providing a context for the present invention. It is not suggested or represented that any or all of these matters formed part of the prior art base or were common general knowledge in the field relevant to the present invention as it existed in Australia before the priority date.

The present invention aims to overcome or at least alleviate one or more of the difficulties associated with the prior art.

SUMMARY OF THE INVENTION

In general, the present invention provides a process for improving the recovery of nickel and cobalt from laterite ores, the method including the steps of:

a) beneficiating the ore to separate it into a beneficiated upgraded ore fraction and a coarse, siliceous low grade rejects fraction which is substantially free from fines and clay materials;
b) separately processing the upgraded ore fraction for the recovery of nickel and cobalt; and
c) subjecting the low grade rejects fraction to a heap leach process with an acid supplemented solution to create a heap leachate for further nickel and cobalt recovery processing.

In general, the process forms part of an overall process for the recovery of nickel and cobalt. The fines and clay materials are separated from the low grade rejects material during the beneficiation process and generally stay with the upgraded fraction. The low grade rejects fraction may be further treated as part of the beneficiation process to remove substantially all the fines and clay material.

The nickel and cobalt is preferably recovered from the beneficiated upgraded ore fraction by high pressure acid leaching (HPAL) or atmospheric pressure agitation leaching to produce a leach solution of nickel and cobalt for further processing. In a preferred embodiment of the invention, the heap leachate from the low grade rejects fraction is blended with the leach solution from the acid leaching process of the upgraded ore fraction. This leads to an increase in the yield of nickel and cobalt recovered from the processing of the whole laterite ore.

The nickel and cobalt may be recovered from the blended leachate by conventional methods such as precipitation as a sulphide or mixed hydroxide, treatment by solvent extraction, ion exchange processes or other known metallurgical processing routes to extract and separate the nickel and cobalt.

The Inventors have surprisingly found that where the low grade siliceous rejects are substantially free of fines and clay materials, they have a high permeability which makes them suitable for heap leaching without the requirement for the pelletisation step needed in treating clay type ores as reported in U.S. Pat. Nos. 5,571,308 and 6,312,500. The high permeability allows a relatively rapid leaching rate with approximately 50% extraction of nickel in 14 days in static tests and over 80% in column leach tests over 160-192 days. Extraction of both nickel and cobalt from the low grade rejects is relatively high with a low acid consumption.

In a particularly beneficial aspect of the present invention, the leachate from the heap leaching of the low grade rejects can be processed together with the leach solution from the acid leaching of the higher grade ore fraction. They can be processed separately if required, however combined processing leads to efficiencies in metal recovery and reduction in equipment requirements. Existing technologies can be used for treatment of the pregnant leach solution, for nickel and cobalt recovery, whether that be for recovery from the blended leachate, or whether the leachate from the upgraded and low grade ore fractions are processed separately. For example, this can be achieved via selective precipitation (i.e. sulphide precipitation, or mixed hydroxide precipitation), solvent extraction, ion exchange or by other known metallurgical processing routes.

In another embodiment, the beneficiation rejects fraction may be produced from the separate beneficiation of the limonite and saprolite fractions of the laterite ore, and the low grade rejects from both the limonite and saprolite fractions each formed into separate low grade rejects heaps. Forming separate heaps has the advantage that leaching the limonite provides for maximum nickel recovery and the saprolite leaching provides for acid neutralisation and iron removal. In the low grade saprolite rejects heap, acid released during the precipitation of the iron content adds to the acid supplemented solution to enhance the leaching of nickel and cobalt.

Accordingly, a further embodiment provides a process for the recovery of nickel and cobalt from laterite ores, the process including the steps of:

a) separating the ore into a limonite fraction and saprolite fraction;
b) beneficiating the limonite and saprolite fractions independently to produce upgraded ore fractions and coarse, siliceous low grade rejects fractions which are substantially free from fines and clay material;
c) independently or together processing the upgraded ore fractions;
d) forming separate heaps of the low grade limonite and the low grade saprolite rejects fractions; and
e) subjecting the separate low grade limonite and the low grade saprolite rejects heaps to a heap leach process with an acid supplemented solution to create separate limonite and saprolite heap leachates for further nickel and cobalt recovery processing.

The nickel and cobalt are preferably recovered from the upgraded ore fraction by processing them together or independently by high pressure acid leaching, atmospheric pressure agitation leaching, or a combination of both, to produce a leach solution for further processing.

The heap leachate from the separated low grade heaps may still be blended with the leach solution from the acid leaching of the upgraded ore fraction to provide further efficiencies in metal recovery, or may be further processed individually or combined.

In yet a further embodiment, the heap leachate from the limonite rejects heap may be passed through the whole or a part of the low grade saprolite rejects heap to assist in neutralizing the acid content and precipitate some of the dissolved iron in the resultant heap leachate. This process may lead to recovering more of the nickel and cobalt from the reject heaps.

The resultant heap leachate, which has been partially neutralised, may be blended with the leach solution from the acid leaching of the upgraded fraction to produce a blended leachate. The blended leachate may then be further processed for cobalt and nickel recovery. As an alternative, the resultant leachate from the low grade ore fractions may be further processed for nickel and cobalt recovery independently from the leach solution from the upgraded ore faction.

Existing technologies such as sulphide or mixed hydroxide precipitation, solvent extraction, ion exchange or other known metallurgical processing routes may be used for the nickel and cobalt recovery processing from the blended or individual low grade reject heap leachates.

The low grade reject heap leaching, as used in the process of the invention, may comprise leaching of formed heaps of the reject material, or "in situ" heap leaching, where the rejects are treated where they are deposited after the beneficiation process, without the need for further movement, eg in a storage dam or other containment.

The acid supplemented solution may comprise a solution of acidified water, seawater or underground brine, or may be the acidified waste solution from the acid leach of the upgraded ore fraction.

The low metal grades of nickel and cobalt, in the low grade rejects fraction may have approximately 0.3% to 0.7% nickel and 0.01% to 0.03% cobalt. This low grade rejects fraction would normally be uneconomic to process by any of the conventional routes. However, removal of substantially all the clay material and fines from the low grade rejects fraction transforms what would previously have been a waste into an economically processable material by application of the heap leach process to this material.

It is particularly attractive where the upgraded ore fraction produced by the beneficiation step is processed in parallel by the HPAL or atmospheric pressure leach processes, or any combination of these processes. In this case the nickel and cobalt acidic solution from both the upgraded laterite ore leaching and the heap leaching of the low grade rejects fraction may be processed together by the same route to produce the required nickel and cobalt products, economising on equipment and capital.

BRIEF DESCRIPTION OF THE DRAWINGS

The description of the drawings is intended to be illustrative of the invention, and it is not intended that the invention is limited to the specific features described.

DETAILED DESCRIPTION

Figure 1:
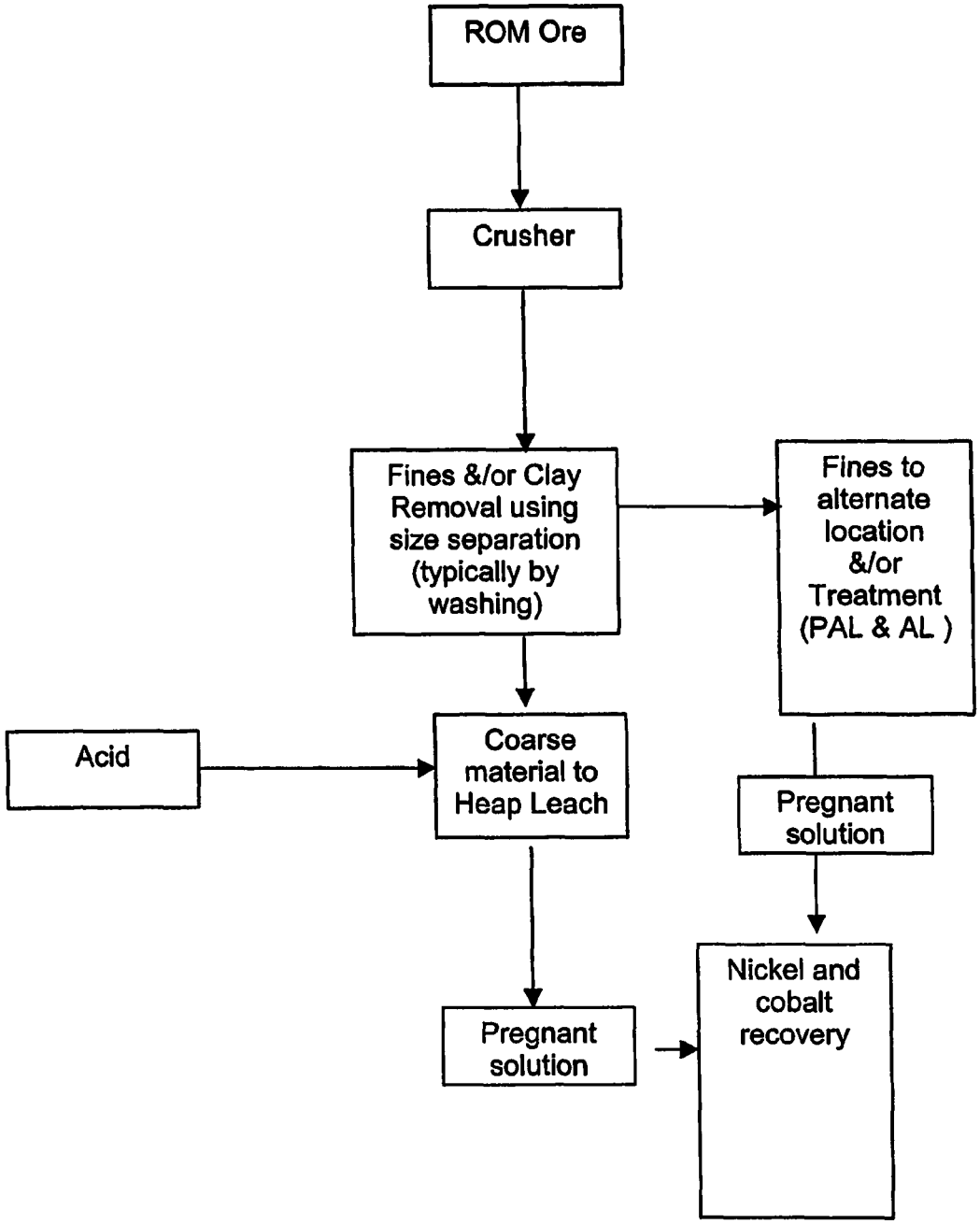
FIG. 1 is a process flow diagram in accordance with one aspect of the present invention.

FIG. 1 illustrates the process flow diagram of the invention. This shows the preliminary treatment of the laterite ore by first undergoing coarse size reduction in a crusher and then removal of the fines and/or clay, which is typically done by washing, for example hydraulically washing as part of the beneficiation process. The coarse material (the low grade rejects fraction), after removal of the fines and/or clay materials, is then subjected to heap leaching with acid to provide a pregnant leachate solution. The upgraded laterite fraction together with the fines material, is sent for nickel recovery treatment by pressure acid leaching or atmospheric leaching. The pregnant leachate solution from this process is combined with the leachate solution from the heap leach process for nickel and cobalt recovery by standard known metallurgical routes.

EXAMPLES

Example 1

Tests were carried out on a dry laterite ore, characterised by containing a large amount of barren quartz and the relative absence of clays. Nickel in the laterite is associated predominantly with the intrinsically fine goethite, which is easily separated from the harder, coarser quartz material. The goethite/limonite zone and saprolite zones are characterised by the occurrence of abundant siliceous net-veins and boxworks, which impart properties conducive to beneficiation.

The beneficiation process involves the physical separation (scrubbing, screening and classification) of the high-grade fine fraction of the ore (product) from the coarse low-grade fraction (reject). Nickel is predominantly associated with very fine-grained iron hydroxide minerals in the limonite zone and very fine-grained weathered nickel-magnesium silicates as well as the very fine-grained iron hydroxide minerals in the saprolite zone. These nickel-bearing minerals are softer than and encapsulated by, the indurated gangue minerals that form a hard cellular vein network. The level of development of this network is greater in the limonite, where weathering has reached a higher level of completion and beneficiation performance is consequently enhanced.

Typically, for the limonite fraction, 57.5% of the nickel and 45.8% of the cobalt are recovered by the drum scrubber beneficiation process from the laterite ore into the high grade (upgraded) laterite. For the saprolite fraction the numbers are 57.3% and 48.9% respectively.

Figure 2:
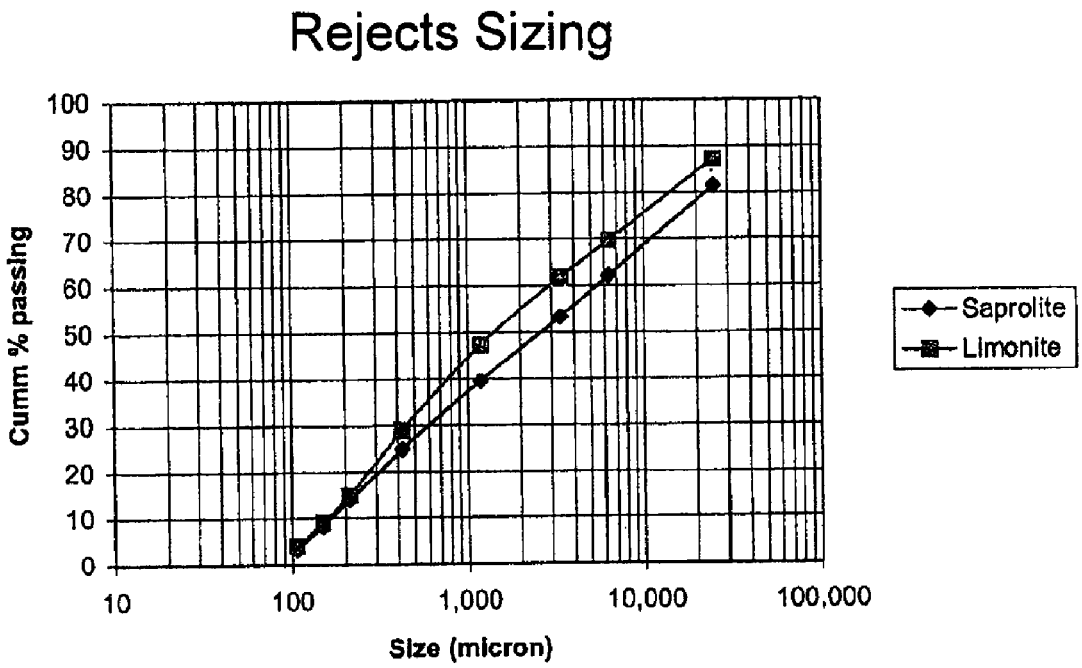
FIG. 2 is a graph showing reject sizing.

The beneficiation low grade rejects are predominately siliceous from the limonite ores and a mixture of silica and serpentenite from the saprolite ores. The beneficiation process strips away all material less than 75 μm leaving a sandy reject with a $D_{50}$ of 1.5 mm-3 mm as shown in FIG. 2. Approximately 10% of the material is greater than 125 mm but 100% less than 250 mm. This material is ideal for heap leach due to the absence of fines and clay material and with a relatively tight size distribution (50% of the material lies between 0.2 and 6.3 mm). This size distribution allows both good flow characteristics without the channelling issues associated with large impervious (either clay or rock) sections.

Testwork

Two size fractions of the rejects (low grade ore) fraction were produced during the beneficiation process and were tested as follows:

The testing took the form of cylinder tests saturated with either 100 kg/t or 200 kg/t of sulphuric acid on 75 μm to 1 mm reject material and 1 mm to 6 mm reject material from the pilot plant operation. The full analysis of the two reject material samples is given in Table 1.

1000 mL measuring cylinders were filled to approximately the 800 mL mark with a known weight of sample and a sulphuric acid solution equating to either of the two concentrations above was added. Each cylinder was rotated twice daily (at the start and finish of day shift) to ensure mixing and no diffusion controlled reactions, thus simulating flow through a heap.

TABLE 1

| | Reject Analysis | | | | | | | | | | |
|---|---|---|---|---|---|---|---|---|---|---|---|
| | Feed % | SG g/cm³ | Ni % | Co % | Al % | Ca % | Fe % | Mg % | Mn % | SiO2 % | $CO_3$ % |
| 1–6 mm Reject Material | 17.9 | 2.66 | 0.49 | 0.021 | 0.3 | 0.5 | 8.5 | 1.1 | 0.09 | 79.0 | 1.9 |
| 75 μm–1 mm Reject Material | 17.1 | 2.86 | 0.52 | 0.030 | 0.3 | 0.8 | 8.2 | 1.1 | 0.12 | 79.1 | 3.1 |

The change in acid concentration and nickel and cobalt extraction, over a 14 day period, were monitored with a full solids/liquids balance of elements determined at the end of the period.

Figure 3:
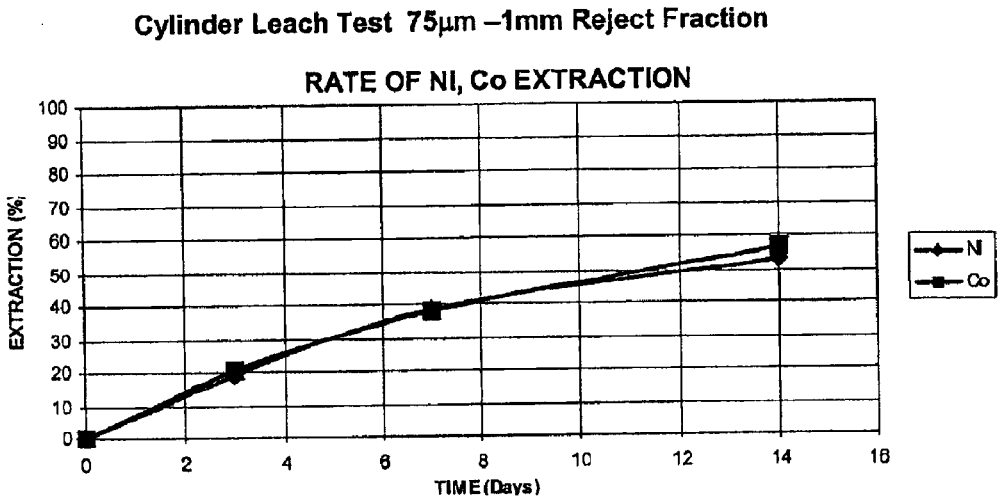
FIG. 3 is a graph relating extraction percentage versus time for a cylinder leach test for a 75 micrometer-1 millimeter reject fraction.
Figure 4:
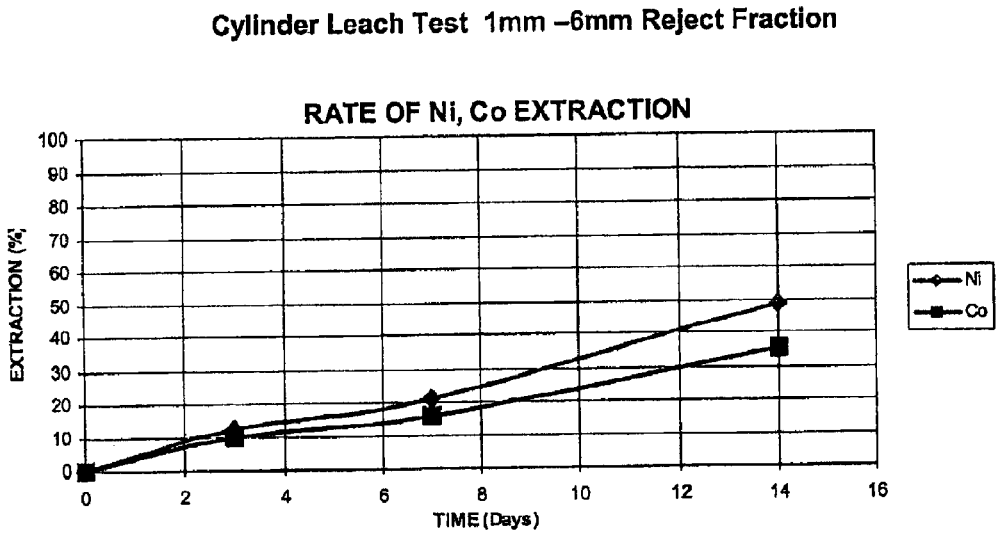
FIG. 4 is a graph relating extraction percentage versus time for a cylinder leach test for a 1 millimeter-6 millimeter reject fraction in accordance with the present invention.

Typically acid consumption was approx. 100 kg/t of solids and, as can be seen from FIGS. 3 & 4, nickel extraction was greater than 50% while cobalt extraction was 55% for the finer size (75 μm-1 mm reject material) and 35% for the coarser size (1-6 mm reject material).

In both cases the extraction of both nickel and cobalt was still increasing after 14 days. The nickel and cobalt tenor of the pregnant solutions is high, reflecting the good extraction levels achieved. These along with the major impurity levels are shown in Table 2.

TABLE 2

| | Elemental distribution of Leach Products in the pregnant solutions | | | | | | | |
|---|---|---|---|---|---|---|---|---|
| Sample | Test Product | Ni (ppm) | Co (ppm) | Fe (%) | Mg (ppm) | Al (ppm) | Ca (ppm) | Mn (ppm) |
| 75 μm–1 mm | Solution | 4965 | 330 | 7.85 | 13625 | 1260 | 280 | 1125 |
| Reject Material | Residue | 2455 | 135 | 4.84 | 4790 | 2370 | 1280 | 392 |
| 1–6 mm | Solution | 4630 | 140 | 6.65 | 9850 | 1200 | 273 | 648 |
| Reject Material | Residue | 2630 | 130 | 5.65 | 5415 | 2095 | 2775 | 438 |

Solution concentrations approaching 5 g/L Ni are comparable with those obtained from the HPAL process or the atmospheric leaching process and this solution would be directly applicable to feed to a solution purification and hydroxide precipitation circuit.

With remaining metal values of 0.25% Ni and 0.013% Co in the heap leach rejects, this represent 75% and 70% nickel and cobalt recovery respectively after taking into account the original beneficiation recovery of around 57.5 and 45.8% respectively, and is a major improvement in overall recovered metal from the ore.

Example 2

The size fractions of the laterite ore beneficiation low grade rejects samples used in Example 1 were recombined in their respective proportions in the original ore for the following testwork to produce a test sample for both the limonite and the saprolite low grade rejects. The analysis of the composite samples is shown in table 3.

TABLE 3

The Composition of the Ore Charged into Column

| Column I.D. | Wet Wt. Kg | $H_2O$ % | Al % | Ca % | Co % | Fe % | Mg % | Mn % | Ni % | Si % | $CO_3$ % |
|---|---|---|---|---|---|---|---|---|---|---|---|
| Saprolite | 31.1 | 19.2 | 0.17 | 1.26 | 0.12 | 4.10 | 11.16 | 0.07 | 0.50 | 25.67 | 10.80 |
| Limonite | 31.5 | 18.2 | 0.37 | 0.40 | 0.03 | 10.30 | 4.18 | 0.16 | 0.68 | 32.15 | 3.60 |

Samples of each reject limonite and saprolite ore were loaded to a height of 4 m in 75 mm diameter clear Perspex columns, and treated with sulphuric acid solution to replicate heap leaching. The feed solution for the columns was 50 g/L sulphuric acid in brine containing 56 g/L total dissolved salt (27 g/L sea salt and 29 g/L added salt).

Acid addition flux rates were progressively increased to a maximum target level of 120 L/m$^2$ h. Flux rates were reduced as necessary to suit the percolation characteristics of each ore type.

The residues from these columns were acid rinsed, dried and assayed and metallurgical balances performed. The nickel and cobalt extraction results are summarised in Table 4 and 5.

TABLE 4

Metal Extractions inside the saprolite Column after 162 Days

| Column | Level From top to bottom | Metal extraction % Al | Co | Fe | Mg | Mn | Ni |
|---|---|---|---|---|---|---|---|
| Saprolite | 0–1 m | 33.42 | 100 | 58.59 | 92.99 | 82.38 | 86.96 |
| | 1–2 m | 36.05 | 100 | 60.23 | 91.02 | 83.08 | 86.22 |
| | 2–3 m | 38.26 | 100 | 57.18 | 89.16 | 83.66 | 85.49 |
| | 3–4 m | 40.15 | 99.17 | 61.57 | 88.72 | 100 | 87.41 |
| | Average ext % | 36.97 | 99.79 | 59.39 | 90.47 | 87.28 | 86.52 |
| | Acid consumtion kg/t | | | 460 | | | |

TABLE 5

Metal Extractions inside the LimoniteColumns after 292 Days

| Column | Level From top to bottom | Metal extraction % Al | Co | Fe | Mg | Mn | Ni |
|---|---|---|---|---|---|---|---|
| Limonite | 0–1 m | 58.31 | 100 | 69.73 | 93.66 | 80.31 | 85.20 |
| | 1–2 m | 55.61 | 100 | 69.17 | 93.96 | 77.21 | 84.19 |
| | 2–3 m | 50.41 | 100 | 65.56 | 92.86 | 69.45 | 82.34 |
| | 3–4 m | 53.19 | 98.23 | 66.02 | 93.86 | 73.48 | 82.62 |
| | Average ext % | 54.38 | 99.56 | 67.62 | 92.61 | 75.11 | 83.59 |
| | Acid consumption kg/t | | | 243 | | | |

The irrigation conductivity was measured and the results are summarised in Table 6

TABLE 6

Irrigation Conductivity of Beneficiation Rejects

| | Ore Type Saprolite | Limonite |
|---|---|---|
| $CO_3$ % wt | 10.80 | 3.60 |
| Irrigation Conductivity* cm/sec | $1.4 \times 10^{-3}$ | $4.2 \times 10^{-4}$ |
| Irrigation Permeability (Flux)* L/(m$^2$ · hr) | 50.4 | 15.1 |

*1 cm/sec = $3.6 \times 10^4$ L/m$^2$ · hr

In the case of both limonite and saprolite, nickel extraction continued to increase at a near linear rate. This example demonstrates that nickel can be effectively recovered from either the low grade reject limonite ore or the low grade reject saprolite ore by heap leaching, following effective fines and clay material removal during beneficiation of the ore.

It is significant that the high recovery of nickel and cobalt from this otherwise unusable material indicated in tables 4 and 5 has the effect of increasing the potential recovery of nickel and cobalt from the whole ore body from approximately 57% and 46% respectively to over 90% for both metals.

Example 3

In order to demonstrate the potential for the use of a low grade saprolite heap leach to be used to treat the leachate from a low grade limonite heap leach to remove some of the dissolved iron and neutralise excess acid values, a synthetic product leach solution was prepared to replicate that produced from the column leaching of the low grade limonite test in Example 2. The solution analysis is indicated in table 7. This solution was used to treat low grade saprolite ore rejects in a column leach test as described in Example 2. The results of the leach after 168 days are indicated in tables 8 and 9 below.

TABLE 7

Composition of Synthetic Limonite Leach product solution

| $H_2SO_4$ g/L | Al g/L | Co g/L | Fe g/L | Mg g/L | Mn g/L | Ni g/L | Sea salt g/L | salt g/L | Total Dissolved Salt g/L |
|---|---|---|---|---|---|---|---|---|---|
| 20 | 3.30 | 0.22 | 37 | 20 | 0.25 | 2.2 | 27 | 29 | 56 |

TABLE 8

Comparison of Feed and Leach Product Solution from the Saprolite Neutralisation Column after 168 days

| | $H_2SO_4$ g/L | Al g/L | Co g/L | Fe g/L | Mg g/L | Mn g/L | Ni g/L |
|---|---|---|---|---|---|---|---|
| Synthetic Limonite Column leach solution-Feed | 20 | 3.30 | 0.22 | 37 | 20 | 0.25 | 2.2 |
| Saprolite Column product Solution(average) | 0 | 2.65 | 0.22 | 25.98 | 24.71 | 0.31 | 2.50 |

TABLE 9

Metal Extractions inside Saprolite Column at 168 Days

| Column | Level From top to bottom | Metal extraction % Al | Co | Fe | Mg | Mn | Ni |
|---|---|---|---|---|---|---|---|
| Saprolite | 0–1 m | −90.09 | −129.99 | −87.34 | 93.52 | 6.42 | 36.07 |
| | 1–2 m | −14.63 | −142.32 | −88.64 | 92.84 | 7.57 | 42.47 |
| | 2–3 m | −70.67 | −145.22 | −154.54 | 85.88 | −8.09 | 20.48 |
| | 3–4 m | −81.17 | −144.98 | −170.19 | 82.19 | −7.99 | 12.99 |
| | Average ext % | −64.14 | −140.63 | −125.18 | 88.61 | −0.52 | 28.00 |

Figure 5:
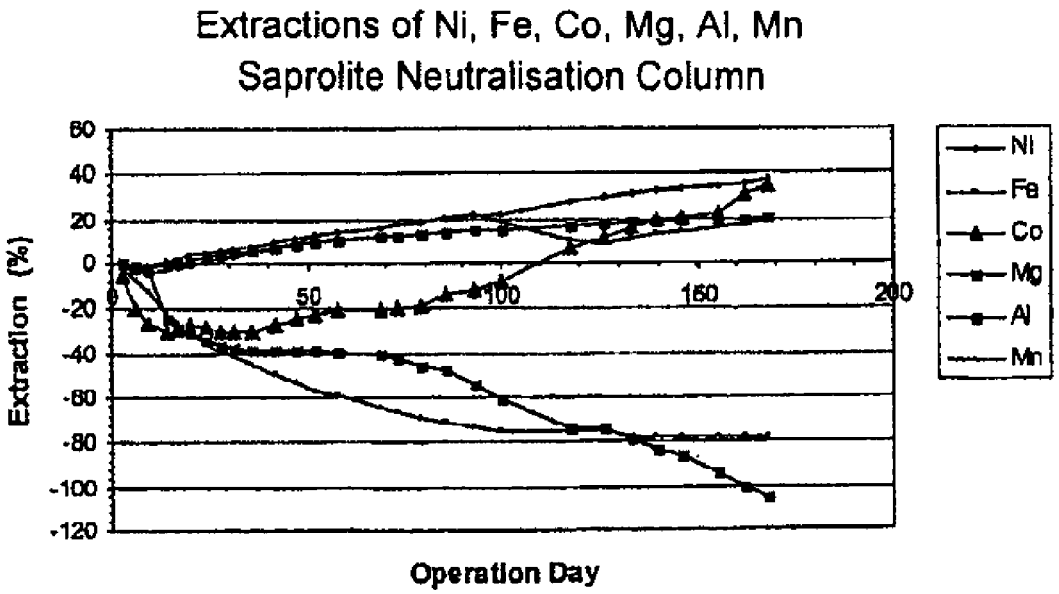
FIG. 5 is a graph relating extraction percentage versus operation day for extractions of nickel, iron, cobalt, magnesium, aluminum and manganese saprolite neutralisation column in accordance with the present invention.

The negative values in the table 9 and FIG. 5 above indicate that material was retained by the ore in the column. This example demonstrates that treatment of the leach solution from a low grade reject limonite ore column leach, by passing it through a low grade saprolite ore column, is successful in neutralising the acid content and reducing the iron content of the solution, thus reducing downstream solution processing requirements, while increasing nickel recovery.

The above description is intended to be illustrative of the preferred embodiment of the present invention. It should be understood by those skilled in the art, that many variations or alterations may be made without departing from the spirit of the invention.

Finally it is to be understood that various other modifications and/or alterations may be made without departing from the spirit of the present invention as outlined herein.

The invention claimed is:

1. A process for the recovery of nickel and cobalt from laterite ores, the process including the steps of:

a) beneficiating the ore by scrubbing, screening and classification to separate it into a beneficiated upgraded ore fraction and a coarse, siliceous low grade rejects fraction which is substantially free from fines and clay materials;

b) separately processing the upgraded ore fraction for the recovery of nickel and cobalt; and c) subjecting the low grade rejects fraction to a heap leach process with an acid supplemented solution to create a heap leachate for further nickel and cobalt recovery processing.

2. A process according to claim 1, wherein the low grade rejects fraction is further treated as part of the beneficiation process to remove substantially all the fines and clay materials.

3. A process according to claim 1, wherein the nickel and cobalt is recovered from the upgraded ore fraction by high pressure acid leaching or atmospheric pressure agitation leaching, or a combination of both, to produce a leach solution for further processing.

4. A process according to claim 1, wherein the heap leachate from the low grade rejects fraction is blended with the leach solution from the acid leaching of the upgraded fraction to produce a blended leachate.

5. A process according to claim 1, wherein the low grade rejects heap leachate is further processed for nickel and cobalt recovery, independently from the leach solution from the upgraded ore fraction.

6. A process according to claim 4 or 5 wherein the nickel and cobalt is recovered from either the blended leachate or the low grade rejects heap leachate by precipitation of a sulphide or mixed hydroxide, treatment by solvent extraction, by ion extraction or by other known metallurgical processing routes.

7. The process according to claim 1, further comprising the steps of:

i) separating the ore into a limonite fraction and saprolite fraction; and ii) forming separate heaps of the low grade limonite and the low grade saprolite rejects fractions;

wherein step i) precedes step a) and step ii) occurs between steps b) and c), and wherein the beneficiating step a) comprises beneficiating the limonite and saprolite fractions independently by scrubbing, screening and classification of each ore fraction to produce upgraded limonite and saprolite ore fractions and coarse, siliceous low grade limonite and saprolite rejects fractions, the siliceous low grade limonite and saprolite rejects fractions being substantially free from fines and clay; material, wherein the processing step b) comprises independently or together processing the limonite and saprolite upgrading ore fractions, and wherein the subjecting step c) comprises subjecting the separate low grade limonite and the low grade saprolite rejects heaps to a heap leach process with an acid supplemented solution to create separate limonite and saprolite heap leachates for further nickel and cobalt recovery processing.

8. A process according to claim 7, wherein the nickel and cobalt are recovered from the upgraded ore fractions by processing them together or independently by high pressure acid leaching, atmospheric pressure agitation leaching or a combination of both, to produce a leach solution for further processing.

9. A process according to claim 7, wherein the limonite and saprolite heap leachates are blended with the leach solution from the acid leaching of the upgraded ore fractions to create a blended leachate for further nickel and cobalt recovery processing.

10. A process according to claim 7 wherein the limonite and saprolite heap leachates are further processed either independently or together for nickel and cobalt recovery, separately from the leach solution from the upgraded ore fraction.

11. A process according to claim 10 wherein the nickel is recovered from the blended leachate or the limonite and saprolite heap leachates by precipitation as a sulphide or mixed hydroxide, treatment by solvent extraction, by ion exchange or by other known metallurgical processing routes.

12. A process according to claim 7 wherein the limonite heap leachate from the low grade limonite rejects heap is passed through the whole, or a part of the low grade saprolite rejects heap to assist in neutralizing the acid content and precipitate some of the dissolved iron in the resultant heap leachate.

13. A process according to claim 12 wherein the resultant heap leachate from the low grade rejects fraction is blended with the leach solution from the acid leaching of the upgraded fraction to produce a blended leachate.

14. A process according to claim 12 wherein the resultant leachate is further processed for nickel and cobalt recovery, independently from the leach solution from the upgraded ore fraction.

15. A process according to claim 13 wherein the nickel and cobalt is recovered from the blended leachate by precipitation of a sulphide or mixed hydroxide, treatment by solvent extraction, by ion exchange, or by other known metallurgical processing routes.

16. A process according to claim 1 wherein the acid supplemented solution is a solution of acidified water, sea water, underground brine or acidified waste solution for the acid leach of the upgraded ore fraction.

17. A process according to claim 1 wherein the beneficiation rejects fraction has from about 0.3% to 0.7% nickel and 0.01% to 0.03% cobalt.

18. A process according to claim 5 wherein the nickel and cobalt is recovered from the low grade rejects heap leachate by precipitation of a sulphide or mixed hydroxide, treatment by solvent extraction, by ion exchange or by other known metallurgical processing routes.

19. A process according to claim 14 wherein the nickel and cobalt is recovered from the resultant heap leachate by precipitation of a sulphide or mixed hydroxide, treatment by solvent extraction, by ion exchange, or by other known metallurgical processing routes.

* * * * *